US005626529A

United States Patent [19]

Roy

[11] Patent Number: 5,626,529

[45] Date of Patent: May 6, 1997

[54] GOLF CLUB SHAFT AND METHOD OF MANUFACTURE

[75] Inventor: Paul A. Roy, Poway, Calif.

[73] Assignee: Vantage Associates, Inc., San Diego, Calif.

[21] Appl. No.: 530,779

[22] Filed: Sep. 18, 1995

[51] Int. Cl.[6] ..... A63B 53/10

[52] U.S. Cl. ..... 473/319; 273/DIG. 23; 156/188; 156/190

[58] Field of Search ..... 273/80 R, 80 B, 273/DIG. 7, DIG. 23; 43/18.5; 156/190, 189, 173, 174, 187, 188; 428/368, 377, 902; 473/319

[56] References Cited

U.S. PATENT DOCUMENTS

| | | | |
|---|---|---|---|
| 4,000,896 | 1/1977 | Lauraitis | 273/80 R |
| 4,023,801 | 5/1977 | Van Auken | 273/DIG. 7 |
| 4,157,181 | 6/1979 | Cecka | 273/80 R |
| 4,319,750 | 3/1982 | Roy | 273/80 B |
| 4,648,598 | 3/1987 | Kim | 273/80 R |
| 4,757,997 | 7/1988 | Roy | 273/80 R |
| 4,836,545 | 6/1989 | Pompa | 273/80 R |
| 4,840,826 | 6/1989 | Shirasaki et al. | 428/36.91 |
| 4,889,575 | 12/1989 | Roy | 273/80 R |
| 4,954,198 | 9/1990 | Viellard | 273/80 R |
| 5,083,780 | 1/1992 | Walton | 273/80 B |
| 5,088,735 | 2/1992 | Shigetoh | 273/80 B |
| 5,143,374 | 9/1992 | Shibasaki | 273/80 B |
| 5,156,396 | 10/1992 | Akatsuka | 273/80 B |
| 5,188,872 | 2/1993 | Quigley | 428/36.2 |
| 5,245,779 | 9/1993 | Suzue et al. | 43/18.5 |

FOREIGN PATENT DOCUMENTS

| | | | |
|---|---|---|---|
| 2273055 | 6/1994 | United Kingdom | 273/80 B |

*Primary Examiner*—Sebastiano Passaniti
*Attorney, Agent, or Firm*—Fish & Richardson P.C.

[57] ABSTRACT

A golf club shaft having a high modulus of elasticity in the grip end of the shaft to enhance stiffness, and a low modulus of elasticity in the tip end of the shaft to provide flexibility, and a method of manufacturing such a golf club shaft is disclosed.

15 Claims, 2 Drawing Sheets

GOLF CLUB SHAFT AND METHOD OF MANUFACTURE

The present invention relates generally to golf club shafts, and more particularly to a composite golf club shaft having a high modulus of elasticity in the grip end of the shaft to enhance stiffness, and a low modulus of elasticity in the tip end of the shaft to provide flexibility, and to a method of manufacturing such a golf club shaft.

BACKGROUND OF THE INVENTION

The shaft of a golf club couples the golfer to the club head with which the golfer strikes the ball. The shaft is the primary component by which the golfer can manipulate the club head in executing the intended shot. In addition to performance or playability of a golf club, there are intangibles that influence a player's like or dislike of a particular product. Of these, the "feel" is of foremost concern. The "feel" is the capability of the golf club to reproduce the shot intended by the golfer, which relates to the confidence instilled in the golfer through his kinesthetic senses that he or she can produce the intended shot.

A golf club shaft may generally be described as a straight rod having a relatively larger diameter grip end, where a material by which the player holds the club is attached, tapering, either gradually or in discrete steps, to a relatively smaller diameter head end, where a club head is attached. Previous golf club shafts have been composed of wood, metal and composite materials.

The subject of the "feel" of a golf club is discussed in U.S. Pat. Nos. 4,319,750, 4,757,997 and 4,889,575, each of which is incorporated herein by reference. These previous patents are directed to golf shafts designed to provide improved payability and "feel". U.S. Pat. Nos. 4,757,997 and 4,889,575 disclose shafts composed of layers of woven and non-woven filamentary fibers. U.S. Pat. No. 4,319,750 discloses a composite shaft having a relatively flexible grip end and a relatively stiff head end.

It has now been discovered that an alternative configuration of composite materials may be used to produce a golf club shaft having improved performance while retaining the desirable characteristics that provide good "feel".

Accordingly, it is an object of the present invention to provide a golf club shaft with enhanced performance while retaining the desirable characteristics that provide good "feel".

Another object of the present invention is to provide a method for making such a golf club shaft.

Yet another object of the present invention is to provide a golf club incorporating such a golf club shaft.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the claims.

SUMMARY OF THE INVENTION

The present invention is directed to a golf club shaft comprising an elongated tube having grip with an initial diameter end tapering to a relatively smaller diameter head end formed as one composite member from at least two kinds of circumferentially superimposed resin-impregnated unidirectional filamentary materials having different moduli of elasticity. The larger diameter grip end of the tube comprises filamentary material having a first modulus of elasticity, while the remainder of the tube comprises filamentary material having a lower second modulus of elasticity. As such, the grip end of the tube has a relatively lower degree of flexibility than the remainder of the tube.

The present invention is further directed to a method of making a golf club shaft comprising obtaining a plurality of plies formed into predetermined patterns from at least two kinds of resin-impregnated unidirectional filamentary materials having different moduli of elasticity. The plies may be assembled on a mandrel tapering from a wide end to a narrow end and having dimensions complementary to the internal dimensions of the completed shaft as follows: A ply of the length of the completed shaft formed from a resin-impregnated unidirectional filamentary material having a relatively low modulus of elasticity, is wrapped onto a mandrel so that its filaments are oriented at an angle to the longitudinal axis of the mandrel. A second ply of the same dimensions as the first ply having its filaments oriented at an angle to the longitudinal axis of the mandrel opposite that of the first ply is then wrapped onto the first ply. An additional ply less than one third the length of the completed shaft, formed from resin-impregnated unidirectional filamentary material having a low modulus of elasticity and having its filaments oriented substantially parallel to the longitudinal axis of the mandrel, may optionally be wrapped onto the second ply at the narrow end of the mandrel in order to reinforce the tip of the shaft. A third ply formed from two resin-impregnated unidirectional filamentary materials spliced together, one material having a high modulus of elasticity and forming from one third to two thirds of the length of the ply starting from the grip end, the other having a relatively low modulus of elasticity, wherein the filaments of both materials are oriented substantially parallel to the longitudinal axis of the mandrel is then wrapped onto the second ply, and, if present, the tip reinforcement ply. Next, a fourth ply, one to three inches longer than the length of the high modulus material in the third ply, formed from resin-impregnated unidirectional filamentary material having a relatively high modulus of elasticity, wherein the filaments are oriented substantially parallel to the longitudinal axis of the mandrel is wrapped onto the third ply at the grip end. This provides additional stiffness to the grip end of the shaft and strengthens the splice joint in the third ply. A fifth ply formed from resin-impregnated unidirectional filamentary material, wherein the filaments are oriented substantially parallel to the longitudinal axis of the mandrel is wrapped onto the fourth and third plies in order to adjust the flex and to provide a finished appearance. Sufficient heat and pressure are applied to the wrapped plies to cure and harden the resin and form an finished integrated structure.

The present invention is also directed to a golf club comprising such a shaft.

BRIEF DESCRIPTION OF THE DRAWINGS

The accompanying drawing, which is incorporated in and constitute a part of the specification, schematically illustrate a preferred embodiment of the invention and, together with the general description given above and the detailed description given below, serve to explain principles of the invention.

DETAILED DESCRIPTION OF THE INVENTION

Figure 1:
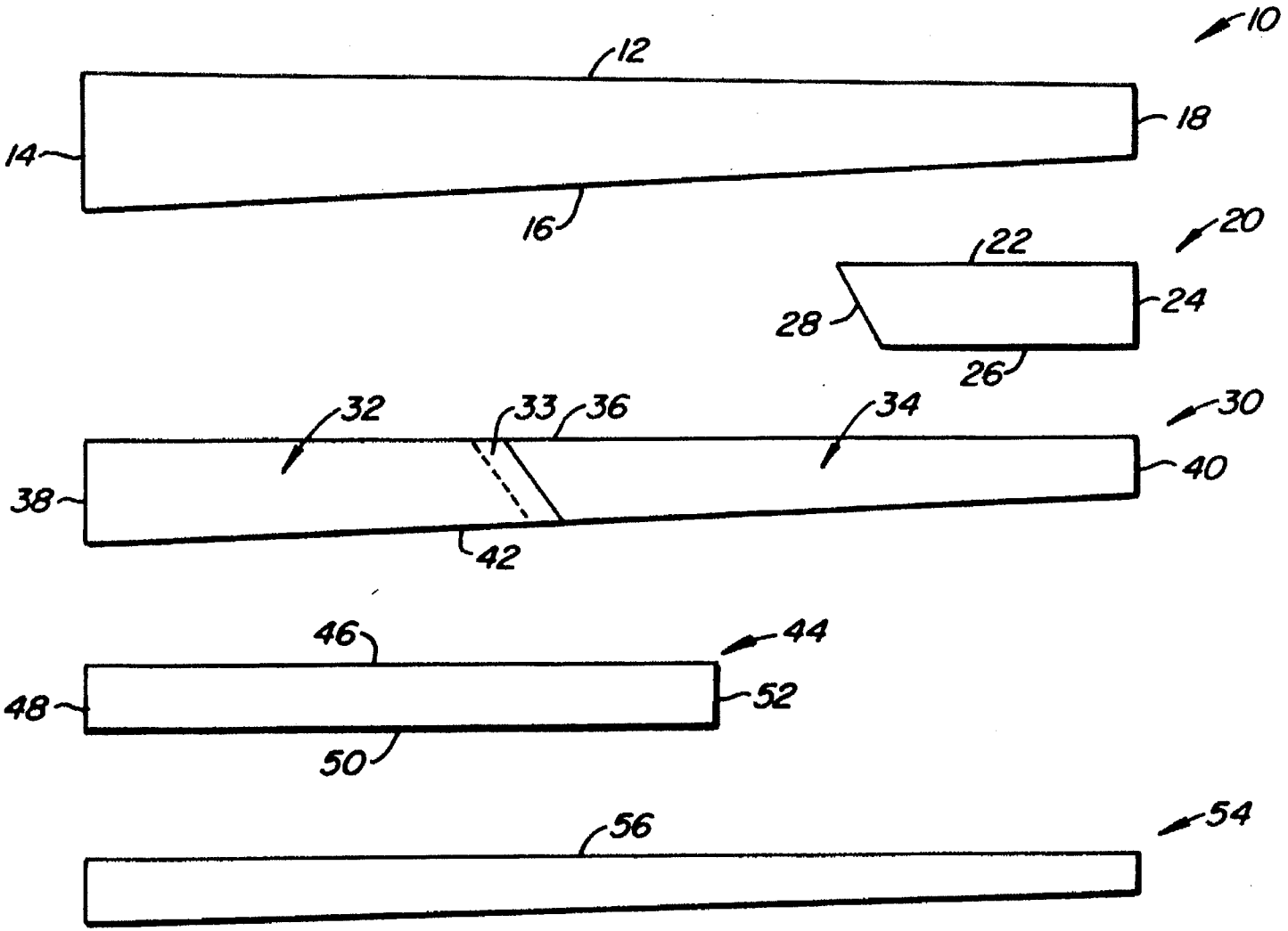
FIG. 1 is schematic plan view of ply patterns used in the fabrication of a golf club shaft according to the present invention.

The present invention, by combining the stiffness attributes of a high modulus unidirectional filamentary material, such as carbon or boron fiber, with the flexibility of a low modulus unidirectional filamentary material, such as glass fiber, in varying amounts and in particular locations, provides the capability to tailor a golf club shaft to the needs of all levels of skill with proper "feel", while also providing improved performance over previous flexible shaft designs.

The present invention will be described in terms of a preferred embodiment, that is, a dual flex composite golf club shaft having a stiff grip end or butt, and a high flex tip, and a method for its manufacture. It should be understood that the term "composite" as used herein is intended to include shafts comprised fiber reinforced with a synthetic resinous material.

A golf club shaft according to the present invention is a substantially tapered tube, usually about 39 to 60 inches long comprised of a plurality of concentrically superimposed layers of resin-impregnated unidirectional filamentary materials having different moduli of elasticity. Preferred examples of such materials are carbon and glass fibers embedded in an heat curing epoxy resin. The nature, quantity and length of each layer can be varied to satisfy the feel and performance needs of players at all skill levels. Conceptually, the invention uses carbon fiber or other high modulus fibers in the butt (grip) end of the shaft to enhance stiffness (feel) in this region and low modulus materials, such as glass fiber, in the tip section for flexibility (performance).

Since "feel" is strongly affected by the flexing in the grip end of the club, the present invention uses a high modulus fiber such as carbon fiber in this region. To suit the individual's particular "feel" requirements the amount and length of the high modulus fibers may be adjusted during manufacture. For example, a strong golfer with a head speed of 100 mph or greater would desire a stiff feeling shaft. Accordingly, the high modulus carbon fiber would extend further down the shaft 30 inches or more from the butt. Weaker players would require lesser amounts and lengths of high modulus fibers to obtain the proper feel to suit their swing.

In many instances, some significant length of glass fiber reinforcement will exist in the tip flex zone for performance. Flex control is attained by wrapping layers of pre-cut patterns of carbon fiber and glass fiber epoxy. In a composite shaft of two or more materials having different moduli of elasticity, there will be a flex point at the interface of two materials. Due to the different flexural characteristics of the materials from which it is formed, such a shaft may be termed a "dual flex" shaft. Varying the quantity and length of each material enables the manufacturer to satisfy the requirements of feel and performance on an individual basis. Briefly, the shaft is preferably constructed from a combination of trapezoidal plies cut into predetermined patterns from resin-impregnated, unidirectional fiber cloth or tape, rolled on to a steel mandrel in a specific sequence, shrink wrapped, and heat cured. Each ply is sized to encircle the mandrel a predetermined number of wraps. Material bias angle and elastic modulus can be varied to achieve the desired torsional and flexural stiffness of the shaft. The shaft torsional stiffness increases with wrap angle; its flexural stiffness decreases with wrap angle. The second variable in degree of shaft stiffness is the composite material's elastic modulus, which could be as low as 7 million pounds per square inch (psi) for fiber glass, to as high as 80 million psi for some carbon fibers.

The shaft begins with a core composed of layers cut at opposing bias angles, to control the shaft torsional stiffness. This core can be varied both in bias angle and material, and typically involves two opposing angle full length sheets that encircle the mandrel from three to five wraps each. Typically, the bias angle can vary from 15 degrees to 45 degrees with respect to the longitudinal axis of the shaft. A preferred embodiment of the present invention comprises a core of four 5 mil thick wraps of S-2 glass epoxy at +15 degrees to the shaft axis, and four 5 mil thick −15 degree layers.

Following the bias wrapped core, a composite shaft usually includes a tip insert to provide added strength in the vulnerable tip region. This insert has the fibers oriented along the shaft axis (0 degrees) and can consist of from two to five wraps.

The next sequence of layers controls the shaft flex and consists of a stiff, high modulus composite (elastic modulus 18 million psi or greater) in the butt (grip) end combined with a low modulus composite material (elastic modulus 10 million psi or less) in the lower portion of the shaft. Both materials have longitudinal fibers (0 degrees). The two materials are combined by overlapping to form a splice joint. The length of each segment can be varied to effect the shaft flexural behavior. The present invention varies the length of the high modulus fiber composite in the butt region from about 15 to 35 inches. The longer the graphite segment the stiffer the shaft and the lower the flexpoint. Typically, the pattern will encircle the shaft from 3 to 5 wraps for a composite material having a nominal thickness of 0.006 inches.

To further enhance the butt stiffness and to reinforce the splice joint, a single layer of high modulus composite material is wrapped on the butt end extending about two inches beyond the splice joint.

A final wrap of high or low modulus material dictated by the flexural stiffness completes the shaft. It is then subjected to sufficient heat and pressure to bond the various superimposed layers into an integrated structure.

Referring to the FIG. 1, ply patterns for a preferred embodiment of a golf club shaft according to the present invention are shown and described in more detail herein below. The plies are preferably cut from resin-impregnated unidirectional filamentary cloth or tape, generally available in roll form. The filamentary materials will generally have a release paper which is used to separate layers of the material prior to use. This release paper, if present, is removed during fabrication of the shaft.

Examples of relatively high modulus materials useful in the present invention include carbon graphite and boron fibers.

Examples of relatively low modulus materials useful in the present invention include fiberglass, Aramid (Kevlar) and Spectra. In all cases, the filaments are arranged parallel to one another and held together and in such longitudinal orientation by a layer of a synthetic resinous material. A preferred resinous material will be heat-curable, such as epoxy resin. Rolls of carbon graphite or boron composite material all commercially available with the carbon graphite filaments each having a diameter of approximately 7 microns, thus producing a tape approximately four inches wide and of indefinite length made up of approximately 130,000 individual carbon graphite fibers. When the tape is fabricated from boron filaments, the boron filaments are of significantly larger diameter, up to approximately 0.004 inch, and thus produce a tape having fewer filaments for a given cross sectional dimension. The preferred glass fiber tape is S-2 glass, manufactured, for example, by Newport Composites.

As shown in FIG. 1, the plies which comprise a preferred embodiment of the golf shaft of the present invention are cut from the appropriate filamentary material as follows:

A first trapezoidal ply 10 is cut from resin-impregnated unidirectional filamentary material having a relatively low modulus of elasticity, so that the filaments are oriented at an angle between about 15 and 45 degrees to its longitudinal axis. Since the ply will be wrapped longitudinally about the mandrel in the manufacture of the shaft, the angle of the fibers to the longitudinal axis of the completed shaft will also be between about 15 and 45 degrees. The ply has a substantially flat base 12 about the length of the completed shaft, that is in the range of 39–60 inches, a relatively wide (grip) end 14 about 5–8 inches long substantially perpendicular to the base 12, a sloping side 16 opposite the base 12, and a relatively narrow (tip) end 18 about 2–3 inches long opposite the wide end 14 and substantially perpendicular to the base 12. The typical dimensions of the ply 10 are determined to allow it to be wrapped about the mandrel 3–5 times.

A second trapezoidal ply (not shown) is cut from the same filamentary material and having the same dimensions as the first ply 10 so that the filaments are oriented at an angle to its longitudinal axis opposite that of the first ply 10.

Where reinforcement of the tip region of the shaft is desired, an additional trapezoidal ply may be cut to provide a "tip insert". The tip insert ply 20 is formed from resin-impregnated unidirectional filamentary material having a relatively low modulus of elasticity. Its filaments are oriented substantially parallel to the longitudinal axis of the ply. The tip insert ply 20 has a substantially flat base 22 of less than one third the length of the completed shaft, generally 10–14 inches in length, a first end 24, the tip end, intermediate in width between the wide and narrow ends of the first and second plies, typically 3–5 inches in length, and substantially perpendicular to the base, a shorter parallel side 26 opposite the base, generally 8–12 inches in length, and a slanted end 28 opposite the first end. The typical dimensions of the tip insert ply 20 are determined to allow it to be wrapped about the mandrel 2–5 times.

A third trapezoidal ply 30, which provides the principal character of the shaft of the present invention, is comprised of two pieces cut from different resin-impregnated unidirectional filamentary materials that are joined together in a splice joint 33 prior to wrapping on the mandrel. One piece 32 is cut from a relatively high modulus of elasticity and forms from one third to two thirds of the length of the ply, starting from the wide (grip) end. The other piece 34 has a relatively low modulus of elasticity. The filaments of both pieces are oriented substantially parallel to the longitudinal axis of the ply.

The length of the two pieces may be varied, generally between about 15–35 inches, depending on the particular flexural characteristics desired of the shaft. The longer the high modulus segment in the grip end of the shaft, the lower the flexpoint.

Splicing is achieved by overlapping the diagonally cut ends of the two pieces about one inch and pressing them together using the natural tack of the uncured epoxy resin for adhesion.

The ply 30 has a substantially flat base 36 of about the length of the completed shaft, a relatively wide (grip) end 38 that may be about 3–5 inches long and is substantially perpendicular to the base 36, a sloping side 40 opposite the base 36, and a relatively narrow (tip) end 42 opposite the wide end 38 and substantially perpendicular to the base 36. The typical dimensions of the ply 10 are determined to allow it to be wrapped about the mandrel 3–5 times.

In order to further stiffen the grip end of the shaft, a fourth trapezoidal ply 44 is cut from resin-impregnated unidirectional filamentary material having a relatively high modulus of elasticity. The filaments of this fourth ply 44 are oriented substantially parallel to the longitudinal axis of the ply. The ply 44 has a substantially flat base 46 one to three inches longer than the length of the high modulus piece 32 in the third ply 30, that is about 16–32 inches long, a relatively wide (grip) end 48 about 1.5–2 inches long substantially perpendicular to the base 46, a sloping side 50 opposite the base 46, and a relatively narrow end 52 about 1.5–2 inches long opposite the wide end 48 and substantially perpendicular to the base 46. The typical dimensions of the ply 10 are determined to allow it to be wrapped about the mandrel 2–4 times.

To provide a clean finish and adjust the stiffness a fifth ply 54 is cut from resin-impregnated unidirectional filamentary material, wherein the filaments are oriented substantially parallel to the longitudinal axis of the ply. This fifth ply 54 is substantially rectangular and has a substantially flat base 56 of about the length of the completed shaft, and is about 1.5–3 inches wide. The typical dimensions of the ply 10 are determined to allow it to be wrapped about the mandrel 2–4 times.

For assembly of the plies into a golf shaft according to the present invention, the mandrel is sprayed or wiped with a liquid release agent and heated or maintained at a temperature of about 110° F. The base 12 of the first ply 10 is aligned with the longitudinal axis of the mandrel and is rolled onto the mandrel while being pressed tightly to the surface of the mandrel and to itself as it completes more than one circumference of the mandrel.

When the first ply 10 is tightly in place over the steel mandrel, the second ply is added to the assembly. Any release paper is removed from the ply, and its base is aligned with the central axis of the steel mandrel, preferably at the place on the circumference where the last layer of the first ply 10 generally ends. The second ply is then pressed into an adhering relationship with the first ply 10 and is rolled tightly onto and into engagement with the first ply 10 on the mandrel.

If a tip insert is to be incorporated into the shaft adjacent the club head end, the tip insert ply 20 is first married to the second ply by removal of its release paper and by adhering the tip insert ply 20 adjacent the tip end of the second ply.

When the second ply (with, if used, the tip insert ply 20) is tightly in place over the first ply 10 on the mandrel, the third ply 30 is added to the assembly. Any release paper is removed from the third ply 30, and its base 36 is aligned with the central axis of the steel mandrel, preferably at the place on the circumference where the last layer of the second ply generally ends. The third ply 30 is then pressed into an adhering relationship with the second ply (and if used, tip insert ply 20) and is rolled tightly onto and into engagement with the second ply on the mandrel.

Next, the fourth ply 44 is added to the golf club shaft assembly by aligning its base 46 with the longitudinal axis of the mandrel, preferably at the place on the circumference where the last layer of the third ply 30 generally ends, and wrapping the fourth ply 44 over the third ply 30 adjacent to the grip end 38 and onto the mandrel.

The fifth ply 54 is then added to the assembly by aligning its base 56 with the longitudinal axis of the mandrel, preferably at the place on the circumference where the last layer of the fourth ply 44 generally ends, and wrapping the fifth ply 54 over the fourth ply 44 and the third ply 30 and onto the mandrel.

After all the blanks are in place on the mandrel, pressure is applied to the wraps and the mandrel by tightly spiral-wrapping the entire shaft with preferably a polypropylene, or TEDLAR®, tape having a width of about one-half to about three-quarters of an inch. (TEDLAR® is a trademark of E. I. du Pont de Nemours & Company.)

The tape-wrapped shaft and mandrel are then placed in an oven to cure the resin. In the preferred embodiment, the resin is epoxy; and the shaft assembly is cured at a temperature of about 300° F. for about one hour to cure the epoxy resin and bind the fibers of the shaft into an integrated structure. Curing temperature may vary depending on the nature of the resin used. After about one hour, the shaft and mandrel are removed from the oven and cooled to about 250° F. The tape wrap is removed from the shaft, and the golf club shaft is removed from the mandrel. The cured shaft is then sanded and coated with a polyurethane paint for cosmetic purposes. The grip end of the shaft may be masked to prevent the application of coating or may be ground after coating to remove the finish. In addition, a fraction of an inch may be trimmed from the ends either before or after the shaft is coated with clear epoxy.

Figure 2:
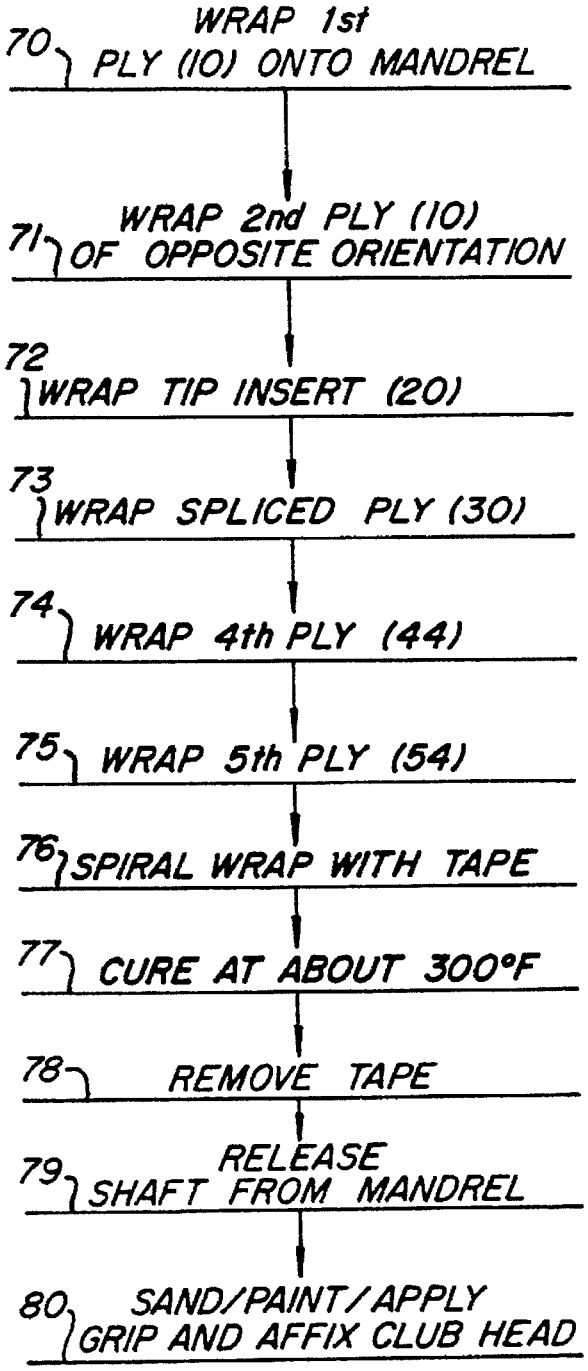
FIG. 2 is a schematic diagram of steps of the preferred embodiment of making a golf club shaft according to the present invention.

Referring to FIG. 2, there is shown the above described steps for making a shaft according to the present invention. The numbers in each of the recited steps refer to the reference numbers of the various plies shown in FIG. 1. In step 70, the first ply is wrapped onto a mandrel. In step 71, a ply of the opposite orientation is applied to first ply followed by the wrapping of the tip insert. The third spliced ply, and the fourth and fifth plies, are wrapped in sequence in steps 73 through 75, respectively. In step 76, the shaft is wrapped with tape, then cured at about 300° F. in step 77, as described above. The tape is removed is step 78 and the shaft is released from the mandrel in step 79. In step 80, the shaft is sanded and painted, and the grip and club head are affixed to the ends of the shaft.

Figure 3:
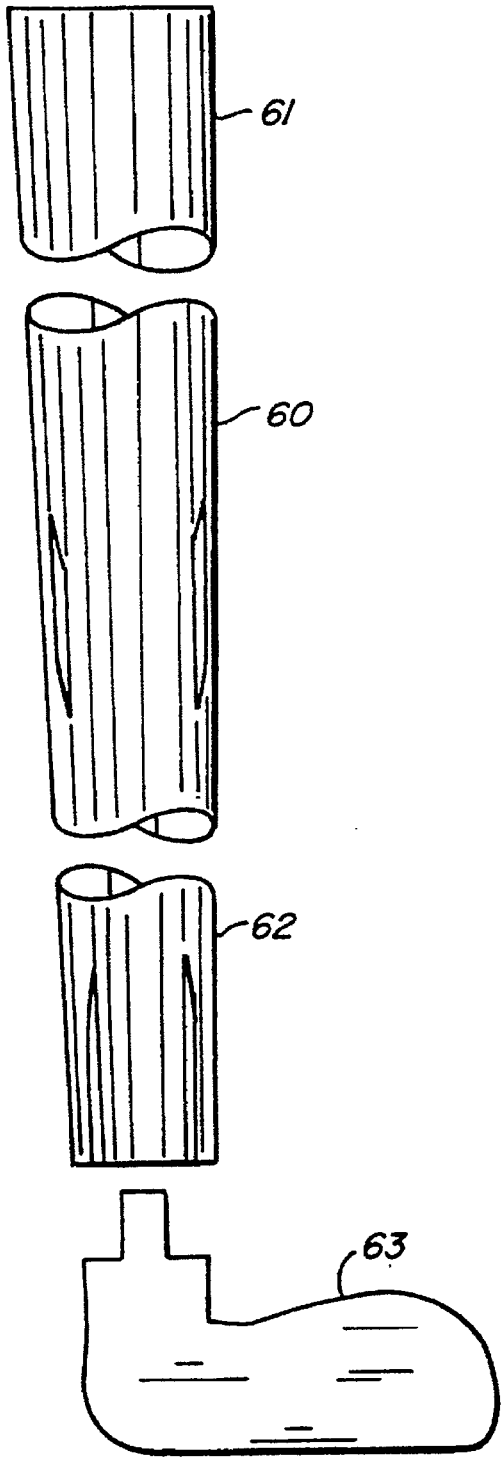
FIG. 3 is a side view showing the assembled shaft and club head according to the present invention.

Referring to FIG. 3, the completed shaft is an elongated tube having a relatively large diameter grip end 61 tapering to a relatively smaller diameter head end 62 formed as one composite member from two different kinds of circumferentially superimposed resin-impregnated unidirectional filamentary materials having different moduli of elasticity. Typically, grip end diameters are in the range of 0.65–0.57 inches, and head end diameters are 0.295–0.340 inches (woods) and 0.33–0.38 inches (irons). The relatively larger diameter grip end of the tube comprises filamentary material having a relatively high modulus of elasticity. The remainder of the tube comprises filamentary material having a relatively significantly lower modulus of elasticity. As such, the grip end of the tube has a relatively lower degree of flexibility than the remainder of the tube. Wall thickness of the shaft is typically in the range of 0.04–0.14 inches. The shaft provides enhanced performance while retaining good "feel".

The shaft so prepared may be incorporated into a golf club by wrapping or otherwise covering the grip end with a suitable grip material such as leather or rubber, and fixing a club head 63 to the tip end by applying a suitable adhesive and inserting the tip end into the hosel of a club head.

Since numerous modifications and changes will readily occur to those skilled in the art, it is not desired to limit the invention to the exact construction and operation shown and described, and accordingly all suitable modification and equivalents may fall within the scope of the invention.

The present invention has been described in terms of a preferred embodiment and is considered as illustrative only of the principles of the invention. The invention, however, is not limited to the embodiment depicted and described. Rather, the scope of the invention is defined by the appended claims.

What is claimed is:

1. A golf club shaft, comprising: an elongated tube having a first diameter grip end tapering to a smaller second diameter head end, said tube formed as a composite from a first and second kind of circumferentially superimposed resin-impregnated unidirectional filamentary materials having different moduli of elasticity wherein;

said first diameter grip end of said tube comprises said first filamentary material having a high modulus of elasticity;

the remainder of said tube consists of said second filamentary material having a lower modulus of elasticity; and said grip end of said tube has a lower degree of flexibility than the remainder of said tube.

2. A golf club shaft according to claim 1, wherein the length of said tube is in the range of 39 to 60 inches.

3. A golf club shaft according to claim 1, wherein said first filamentary material is selected from the group consisting of resin-impregnated carbon graphite filaments, boron filaments and mixtures of carbon and graphite filaments;

and said second filamentary material is selected from the group consisting of resin-impregnated glass fibers and filaments.

4. A method of making a golf club shaft having a grip end and head end, utilizing a plurality of plies formed into predetermined patterns from at least two different kinds of resin-impregnated unidirectional filamentary materials having different moduli of elasticity and a mandrel tapering from a wide end to a narrow end and having dimensions complimentary to the internal dimensions of said shaft, comprising the steps of:

(a) wrapping onto said mandrel a first ply of said shaft formed from a first resin-impregnated unidirectional filamentary material having a first modulus of elasticity, and having its filaments oriented at a first angle to the longitudinal axis of the mandrel;

(b) wrapping onto said first ply a second ply of substantially similar dimensions to said first ply, said second ply having its filaments oriented at a second angle to the longitudinal axis of the mandrel which is different from said first angle;

(c) wrapping onto said second ply a third ply formed from two resin-impregnated unidirectional filamentary materials spliced together, one material having a high modulus of elasticity and forming from about one third to two thirds of the length of said third ply starting from said narrow end, the other material having a relatively low modulus of elasticity, wherein the filaments of both materials are oriented substantially parallel to the longitudinal axis of the mandrel;

(d) wrapping onto the third ply at said grip end a fourth ply which is longer than the length of said high modulus material of said third ply, said fourth ply being formed from resin-impregnated unidirectional filamentary material having a high modulus of elasticity, wherein the filaments are oriented substantially parallel to the longitudinal axis of said mandrel;

(e) wrapping onto said fourth ply a fifth ply formed from resin-impregnated unidirectional filamentary material, wherein the filaments are oriented substantially parallel to the longitudinal axis of the mandrel;

(f) applying sufficient heat and pressure to the wrapped plies to cure and harden the resin and form an integrated structure.

5. A method according to claim 4, further comprising, between steps (b) and (c), the step (b') of wrapping onto said second ply at said narrow end of said mandrel an additional ply covering less than one third the length of said shaft, said additional ply formed from resin-impregnated unidirectional filamentary material having a relatively low modulus of elasticity and having its filaments oriented substantially parallel to the longitudinal axis of said mandrel.

6. A method of making a golf club shaft from a plurality of plies formed into predetermined patterns from at least two different kinds of resin-impregnated unidirectional filamentary materials having different moduli of elasticity, and a mandrel tapering from a wide end to a narrow end and having dimensions complimentary to the internal dimensions of said shaft, comprising the steps of:

(a) aligning with the longitudinal axis of said mandrel the base of a first trapezoidal ply formed from a first resin-impregnated unidirectional filamentary material having a low modulus of elasticity, wherein the filaments are oriented at a first angle to the longitudinal axis of the ply, said ply having a substantially flat base of the length of the completed shaft, a relatively wide end substantially perpendicular to the base, a sloping side opposite the base, and a relatively narrow end opposite to said wide end and substantially perpendicular to said base, and wrapping said first ply onto said mandrel;

(b) aligning with the longitudinal axis of said mandrel the base of a second trapezoidal ply formed from said first filamentary material and having substantially similar dimensions as said first ply, wherein the filaments are oriented at a second angle to the longitudinal axis of said second ply, and wrapping said second ply onto the said ply;

(c) aligning with the longitudinal axis of said mandrel the base of a third trapezoidal ply formed from two resin-impregnated unidirectional filamentary materials spliced together, one material having a low modulus of elasticity and forming from about one third to two thirds of the length of said third ply starting from the wide end, the other material having a relatively low modulus of elasticity, wherein the filaments of both materials are oriented substantially parallel to the longitudinal axis of said third ply, said third ply having a substantially flat base of the length of said shaft, a relatively wide end substantially perpendicular to the base, a sloping side opposite the base, and a relatively narrow end opposite the wide end and substantially perpendicular to the base, and wrapping said third ply onto said second ply so that the filaments of said third ply are substantially parallel to the longitudinal axis of said mandrel;

(d) aligning with the longitudinal axis of said mandrel the base of a fourth trapezoidal ply formed from resin-impregnated unidirectional filamentary material having a high modulus of elasticity, wherein the filaments are oriented substantially parallel to the longitudinal axis of said fourth ply, said fourth ply having a substantially flat base longer than the length of the high modulus material in said third ply, a relatively wide end substantially perpendicular to the base, a sloping side opposite the base, and a relatively narrow end opposite the wide end and substantially perpendicular to the base, and wrapping said fourth ply onto said third ply at the wide end of said third ply so that the filaments of said fourth ply are substantially parallel to the longitudinal axis of the mandrel;

(e) aligning with the longitudinal axis of said mandrel the base of a fifth ply formed from resin-impregnated unidirectional filamentary material, wherein the filaments are oriented substantially parallel to the longitudinal axis of said fifth ply, said fifth ply being substantially rectangular and having a substantially flat base of the length of said shaft, and wrapping said fifth ply onto the fourth and third plies, so that the filaments of said fifth ply are substantially parallel to the longitudinal axis of said mandrel;

(f) applying sufficient heat and pressure to the wrapped plies to cure and harden the resin and form an integrated structure.

7. A method according to claim 6, further comprising, between steps (b) and (c), the step (b') of aligning with the longitudinal axis of said mandrel the base of an additional trapezoidal ply formed from resin-impregnated unidirectional filamentary material having a low modulus of elasticity, wherein the filaments are oriented substantially parallel to the longitudinal axis of said additional ply, said additional ply having a substantially flat base of less than one third the length of said shaft, a first end, intermediate in width between the wide and narrow ends of the first and second plies, substantially perpendicular to the base, a shorter parallel side opposite the base, and a slanted end, and wrapping said additional ply onto the second ply at the narrow end of said second ply, so that the filaments of said additional ply are substantially parallel to the longitudinal axis of the mandrel.

8. A method according to claim 6, wherein the filaments of said first ply are oriented at an angle between 15° and 45° to the longitudinal axis of said first ply.

9. A method according to claim 6, wherein said plies are obtained by cutting from resin-impregnated unidirectional fiber cloths.

10. A golf club shaft made according to the method of claim 4.

11. A golf club shaft made according to the method of claim 6.

12. A golf club shaft, comprising: an elongated tube having a relatively large diameter grip end tapering to a relatively smaller diameter head end, said tube formed as a composite member comprising a pair of circumferentially superimposed layers of a resin-impregnated unidirectional filamentary material having a relatively low modulus of elasticity, wherein said layers have, respectively, fibers oriented in opposite angles between 15° and 45° to the longitudinal axis of said tube; a third layer circumferentially superimposed about said first pair of layers formed from two resin-impregnated unidirectional filamentary materials spliced together, one material having a relatively high modulus of elasticity and forming from one third to two thirds of the length of the tube starting from said grip end, the other having a relatively low modulus of elasticity, wherein the filaments of both materials are oriented substantially parallel to the longitudinal axis of said tube; a fourth layer circumferentially superimposed about said third layer at said grip end, longer than the length of the high modulus material in said third layer, formed from resin-impregnated unidirectional filamentary material having a relatively high modulus of elasticity, wherein the filaments are oriented substantially parallel to the longitudinal axis of the tube; and a fifth layer of the length of said shaft circumferentially superimposed about said third and fourth layers, formed from resin-impregnated unidirectional filamentary material having a relatively low modulus of elasticity, wherein the filaments are oriented substantially parallel to the longitudinal axis of said tube.

13. A golf shaft according to claim 12, further comprising, an additional layer circumferentially superimposed about said pair of layers at said head end, less than one third the length of said shaft formed from resin-impregnated unidirectional filamentary material having a relatively low modulus of elasticity and having the filaments of said additional layer oriented substantially parallel to the longitudinal axis of said tube.

14. A golf club, comprising:

a club head; and a shaft, said shaft comprising:

an elongated tube having a relatively large diameter grip end tapering to a relatively smaller diameter head end, said tube formed as one composite member from at least two different kinds of resin-impregnated unidirectional filamentary material having different moduli of elasticity;

said relatively large diameter grip end of said tube consists of filamentary material having a relatively high modulus of elasticity; the remainder of said tube comprising filamentary material having a significantly lower modulus of elasticity;

wherein the grip end of said tube has a lower degree of flexibility than the remainder of said tube.

15. A golf club, comprising:

a club head; and a shaft, said shaft comprising:

an elongated tube having a relatively large diameter grip end tapering to a relatively smaller diameter head end, said tube formed as one composite member comprising a pair of circumferentially superimposed layers of a resin-impregnated unidirectional filamentary material having a low modulus of elasticity, and wherein said layers have, respectively, fibers oriented an opposite angles between 15° and 45° to the longitudinal axis of said tube; a third layer circumferentially superimposed about said first pair of layers formed from two resin-impregnated unidirectional filamentary materials spliced together, one material having a low modulus of elasticity and forming from one third to two thirds of the length of said tube starting from said grip end, the other material having a relatively high modulus of elasticity, wherein the filaments of both materials are oriented substantially parallel to the longitudinal axis of said tube; a fourth layer circumferentially superimposed about said third layer at said grip end, longer than the length of said high modulus material in said third layer, formed from resin-impregnated unidirectional filamentary material having a relatively high modulus of elasticity, wherein said filaments of said fourth layer are oriented substantially parallel to the longitudinal axis of said tube; and a fifth layer of the length of said shaft circumferentially superimposed about said third and fourth layers, formed from resin-impregnated unidirectional filamentary material having a relatively low modulus of elasticity, wherein the filaments are oriented substantially parallel to the longitudinal axis of said tube.

* * * * *